US009804556B2

(12) United States Patent
Eto

(10) Patent No.: US 9,804,556 B2
(45) Date of Patent: Oct. 31, 2017

(54) IMAGE FORMING APPARATUS THAT FACILITATES POSITIONING AND ATTACHMENT/DETACHMENT OF IMAGE FORMING UNIT

(71) Applicant: Kyocera Document Solutions Inc., Osaka (JP)

(72) Inventor: Daisuke Eto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/242,635

(22) Filed: Aug. 22, 2016

(65) Prior Publication Data

US 2017/0060080 A1 Mar. 2, 2017

(30) Foreign Application Priority Data

Aug. 26, 2015 (JP) ..... 2015-166873

(51) Int. Cl.
*G03G 15/08* (2006.01)
*G03G 21/16* (2006.01)

(52) U.S. Cl.
CPC ..... *G03G 21/1647* (2013.01); *G03G 15/0875* (2013.01); *G03G 21/1676* (2013.01)

(58) Field of Classification Search
CPC ..... G03G 15/0875; G03G 21/1647; G03G 21/1676
USPC ..... 399/110, 119
See application file for complete search history.

(56) References Cited

U.S. PATENT DOCUMENTS 7,912,404 B2 * 3/2011 Hoshi et al. ..... G03G 21/1853 399/110
8,099,020 B2 * 1/2012 Mase et al. ..... G03G 15/0822 399/119
8,824,920 B2 9/2014 Eto

* cited by examiner

*Primary Examiner* — William J Royer
(74) *Attorney, Agent, or Firm* — James Judge

(57) ABSTRACT

An image forming apparatus includes an apparatus main body, an image forming unit, a guiding portion, a positioning mechanism, and a posture-switchable lever member. The positioning mechanism is disposed on the guiding portion, and provided with a first urging member and a unit-abutting portion for abutting on the image forming unit. The positioning mechanism positions the image forming unit by urging the image forming unit when attached into the apparatus main body in a first position. The posture-switchable lever member is provided swingably on the image forming unit and switches between a first posture in which the posture-switchable lever member locks the image forming unit in the first position within the apparatus main body, and a second posture in which the posture-switchable lever member releases the lock on the image forming unit and permits the image forming unit to be detached from the apparatus main body along the attachment/detachment direction.

7 Claims, 10 Drawing Sheets

IMAGE FORMING APPARATUS THAT FACILITATES POSITIONING AND ATTACHMENT/DETACHMENT OF IMAGE FORMING UNIT

INCORPORATION BY REFERENCE

This application is based upon, and claims the benefit of priority from, corresponding Japanese Patent Application No. 2015-166873 filed in the Japan Patent Office on Aug. 26, 2015, the entire contents of which are incorporated herein by reference.

BACKGROUND

Unless otherwise indicated herein, the description in this section is not prior art to the claims in this application and is not admitted to be prior art by inclusion in this section.

There is known a typical image forming apparatus, which forms an image on a sheet, that includes an apparatus main body, a photoreceptor drum (an image carrier), and a developing device. The developing device includes a developing roller opposed to the photoreceptor drum. There is provided a technique where a developing device is attachable/detachable with respect to an apparatus main body.

The developing device is attached to and detached from the apparatus main body as an image forming unit. The apparatus main body includes a rail member and a cutout portion formed at one end of the rail member. On the other hand, the image forming unit includes a roller that is rotatable and rotates on the rail member. In attaching the image forming unit, the roller derailing from the rail member and entering the cutout portion positions the image forming unit at a predetermined position inside the apparatus main body.

SUMMARY

An image forming apparatus according to one aspect of the disclosure includes an apparatus main body, an image forming unit, a guiding portion, a positioning mechanism, and a posture-switchable lever member. The image forming unit is attachable to and detachable from the apparatus main body along a predetermined attachment/detachment direction with respect to the apparatus main body. The guiding portion is disposed in the apparatus main body, for guiding attachment/detachment of the image forming unit. The positioning mechanism is disposed on the guiding portion, and provided with a first urging member and a unit-abutting portion for abutting on the image forming unit. The positioning mechanism positions the image forming unit by urging the image forming unit when attached into the apparatus main body in a first position. The posture-switchable lever member is provided swingably on the image forming unit. The posture-switchable lever member switches between a first posture in which the posture-switchable lever member locks the image forming unit in the first position within the apparatus main body, and a second posture in which the posture-switchable lever member releases the lock on the image forming unit and permits the image forming unit to be detached from the apparatus main body along the attachment/detachment direction.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
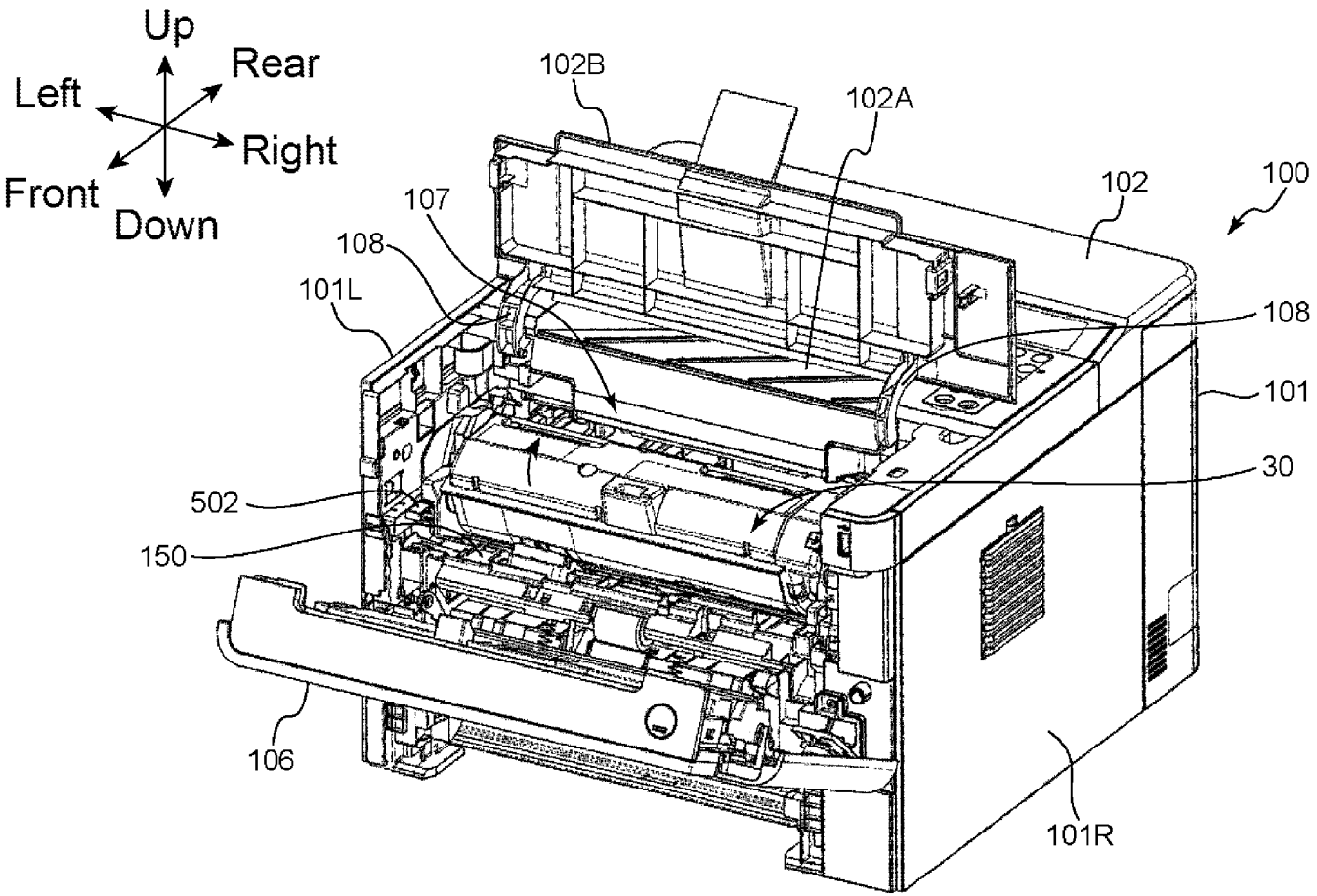
FIG. 1 obliquely illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
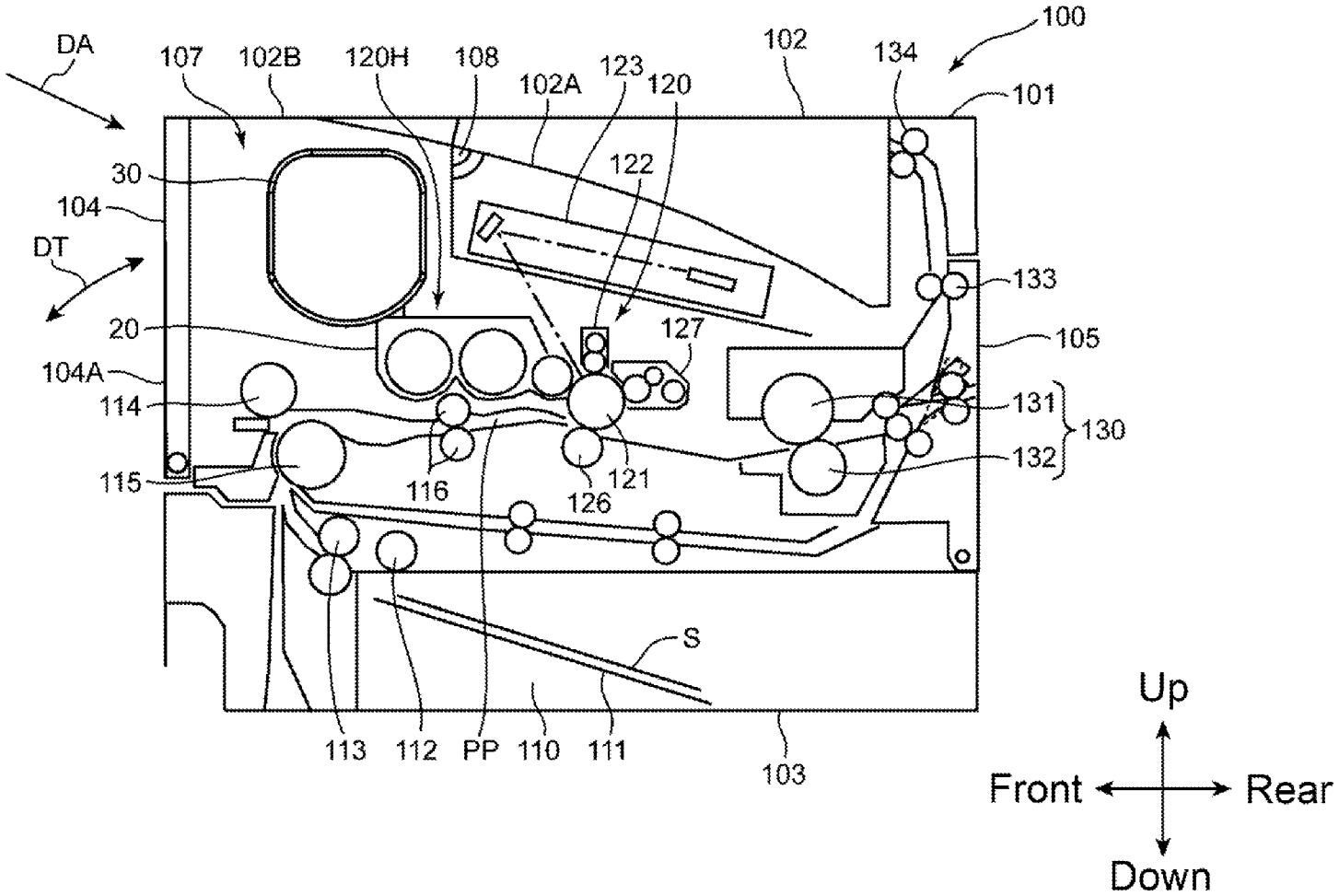
FIG. 2 illustrates a cross section inside the image forming apparatus according to the one embodiment.

Referring to the drawings, the following describes one embodiment of the disclosure. FIG. 1 obliquely illustrates a printer 100 (an image forming apparatus) according to the embodiment. FIG. 2 schematically illustrates a cross section of the internal structure of the printer 100. While the printer 100 illustrated in FIGS. 1 and 2 is, what is called, a black-and-white printer, the image forming apparatus may be a color printer, a facsimile device, a multi-functional peripheral that has these functions, and other apparatuses for forming toner images on sheets, in other embodiments. In the following description, directional terms like "up," "down," "front," "rear," "left," and "right" are simply used for clarifying the description without limiting principles of the image forming apparatus.

The printer 100 includes a housing 101 (an apparatus main body) that houses various devices for forming images on a sheet S. The housing 101 includes an upper wall 102 defining the top surface of the housing 101, a bottom wall 103 defining the bottom surface of the housing 101, a main-body rear wall 105 between the upper wall 102 and the bottom wall 103, and a main-body front wall 104 located in front of the main-body rear wall 105. The housing 101 has a main-body internal space 107 where various kinds of devices are located. In the main-body internal space 107 of the housing 101, a sheet conveyance path PP that conveys the sheet S in a predetermined conveyance direction runs. The housing 101 includes a pair of a left-side wall 101L and a right-side wall 101R (see FIG. 1). The left-side wall 101L and the right-side wall 101R are wall portions that form the right and left side surfaces of the housing 101.

In the center of the upper wall 102, a paper sheet discharge unit 102A is located. The paper sheet discharge unit 102A has an inclined surface inclining downward from the front portion toward the rear portion of the upper wall 102. The sheet S with images formed in an image forming unit 120, which will be described later, is discharged into the paper sheet discharge unit 102A. In the main-body front wall 104, a front cover 106 including a manual bypass tray 104A is located. The front cover 106 is vertically turnable with its lower end as a fulcrum (an arrow DT in FIG. 2). On the other hand, a front end portion 1026 of the upper wall 102 is turnable rearward with an arm 108 as a fulcrum (see FIG. 1). As illustrated in FIG. 1, when the front end portion 102B and the front cover 106 of the upper wall 102 are each opened, the main-body internal space 107 is exposed outside the printer 100. This results in that an image forming unit 120H, which will be described later, is attachable inside the housing 101. When a sheet S gets stuck in the sheet conveyance path PP, the sheet S will become removable.

Referring to FIG. 2, the printer 100 includes a cassette 110, a pickup roller 112, a first feed roller 113, a second feed roller 114, a conveyance roller 115, a registration roller pair 116, the image forming unit 120, and a fixing unit 130.

The cassette 110 internally houses the sheets S. The cassette 110 includes a lift plate 111. The lift plate 111 inclines so as to push up the leading edge of the sheet S. The cassette 110 is extractable forward with respect to the housing 101.

The pickup roller 112 is located on the leading edge of the sheet S pushed up by the lift plate 111. Rotation of the pickup roller 112 pulls the sheet S out of the cassette 110.

The first feed roller 113 is located in the downstream side of the pickup roller 112 and further sends out the sheet S downstream. The second feed roller 114 is located in the inside (the rear side) of the fulcrum of the manual bypass tray 104A and pulls the sheet S on the manual bypass tray 104A inside the housing 101.

The conveyance roller 115 is located in the downstream side (hereinafter also simply referred to as downstream) of a sheet conveyance direction (hereinafter also simply referred to as a conveyance direction) of the first feed roller 113 and the second feed roller 114. The conveyance roller 115 further conveys the sheet S, which is sent out by the first feed roller 113 and the second feed roller 114, downstream.

The registration roller pair 116 has a function of correcting an oblique conveyance of the sheet S. This adjusts a position of an image to be formed on the sheet S. The registration roller pair 116 supplies the image forming unit 120 with the sheet S in accordance with timing of the image formation by the image forming unit 120.

The image forming unit 120 includes a photoreceptor drum 121 (an image carrier), a charger 122, an exposure apparatus 123, a developing device 20, a toner container 30 (a developer housing container), a transfer roller 126, and a cleaning apparatus 127. As will be described later, the developing device 20 and the toner container 30 are integrally attachable/detachable with respect to the housing 101 as the image forming unit 120H.

The photoreceptor drum 121 has a cylindrical shape and is rotatably supported by the housing 101. The photoreceptor drum 121 has a circumference surface where an electrostatic latent image is formed and carries a toner image (a developer image) corresponding to this electrostatic latent image on the circumference surface. The charger 122 applied with a predetermined voltage causes the circumference surface of the photoreceptor drum 121 to be approximately evenly charged.

The exposure apparatus 123 irradiates the circumference surface of the photoreceptor drum 121 charged by the charger 122 with a laser beam. This laser beam is irradiated in accordance with image data output from an external device (not illustrated) such as a personal computer communicatively connected to the printer 100. This results in forming the electrostatic latent image corresponding to the image data on the circumference surface of the photoreceptor drum 121.

The developing device 20 supplies a toner (developer) to the circumference surface of the photoreceptor drum 121 on which the electrostatic latent image is formed. The toner container 30 replenishes the toner to the developing device 20. The toner container 30 is located to be attachable/detachable with respect to the developing device 20. Supplying the toner to the photoreceptor drum 121 by the developing device 20 develops (visualizes) the electrostatic latent image formed on the circumference surface of the photoreceptor drum 121. This results in forming the toner image (the developer image) on the circumference surface of the photoreceptor drum 121.

The transfer roller 126 is located opposed to the photoreceptor drum 121 across the sheet conveyance path PP under the photoreceptor drum 121. The transfer roller 126 forms a transfer nip portion with the photoreceptor drum 121 and transfers the toner image to the sheet S.

The cleaning apparatus 127 removes the toner left on the circumference surface of the photoreceptor drum 121 after the toner image has been transferred to the sheet S.

The fixing unit 130 is located in the downstream side of the conveyance direction with respect to the image forming unit 120 and fixes the toner image on the sheet S. The fixing unit 130 includes a heating roller 131 that melts the toner on the sheet S and a pressure roller 132 that causes the sheet S to be brought into close abutment on the heating roller 131.

The printer 100 further includes a conveyance roller pair 133 located in the downstream side of the fixing unit 130 and a discharge roller pair 134 located in the downstream side of the conveyance roller pair 133. The sheet S is conveyed upward by the conveyance roller pair 133 and is finally discharged out of the housing 101 by the discharge roller pair 134. The sheet S discharged out of the housing 101 is stacked on the paper sheet discharge unit 102A.

Figure 3:
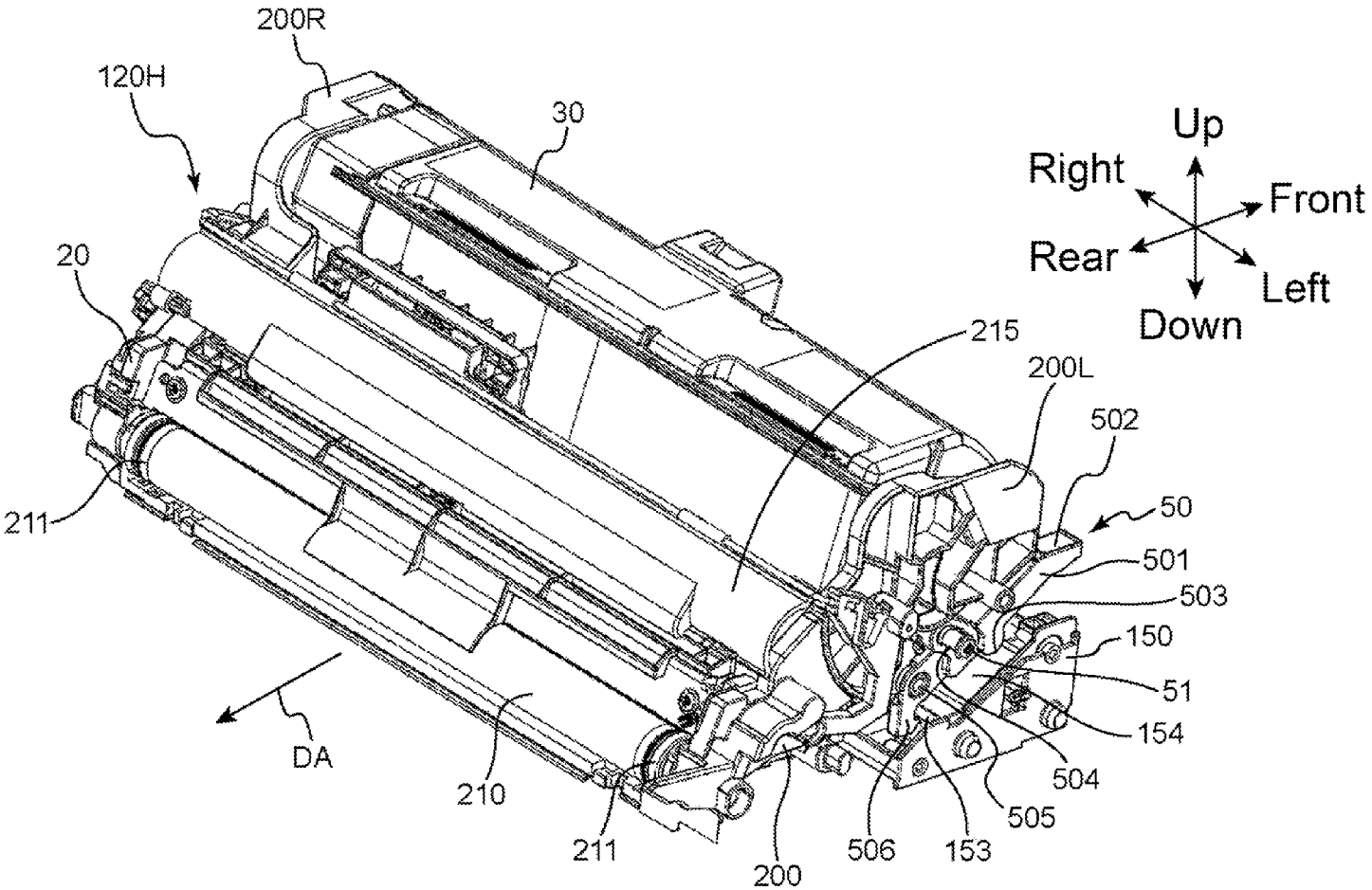
FIG. 3 obliquely illustrates an image forming unit and a guiding portion according to the one embodiment.
Figure 4:
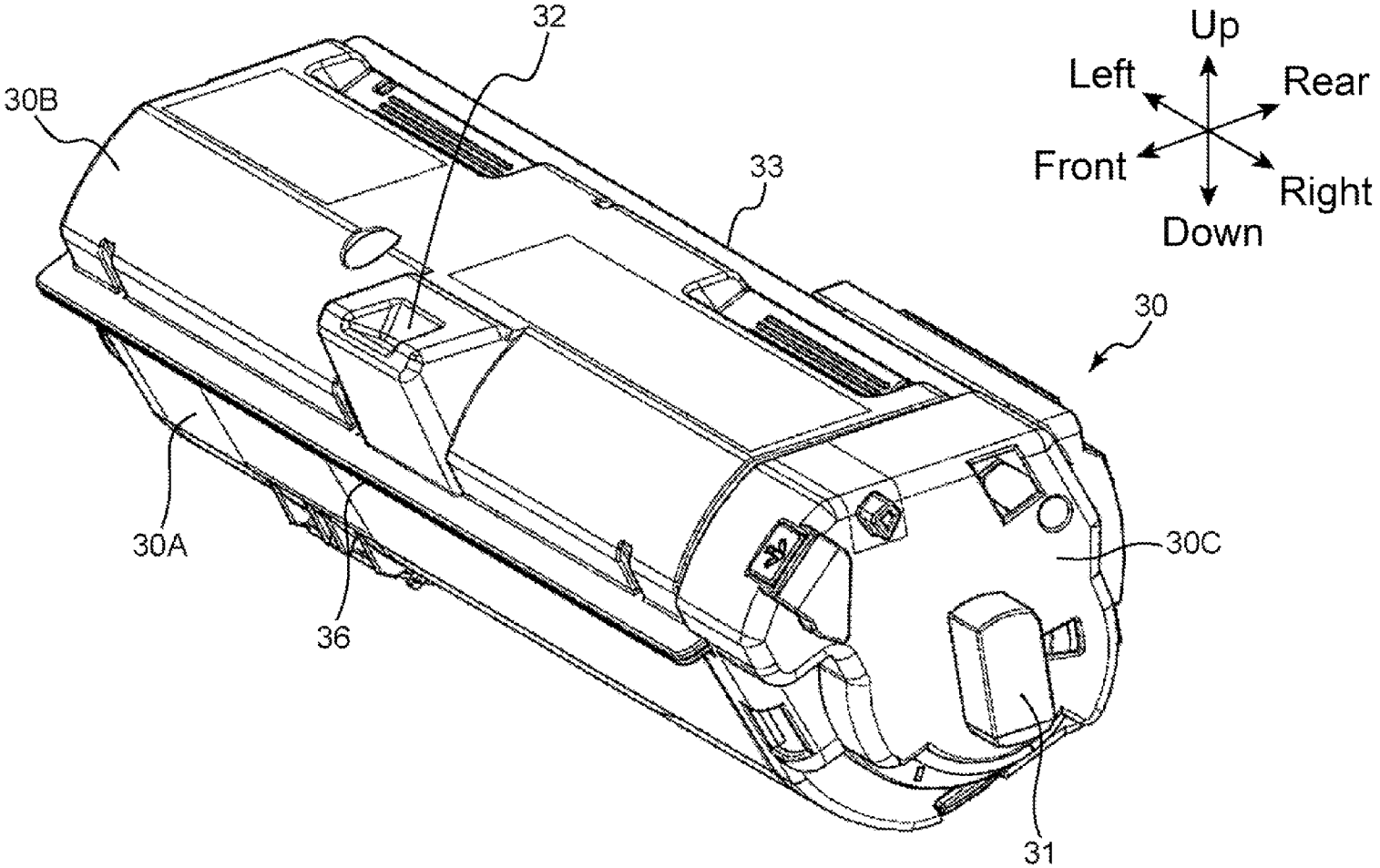
FIG. 4 obliquely illustrates a developer housing container according to the one embodiment.
Figure 5:
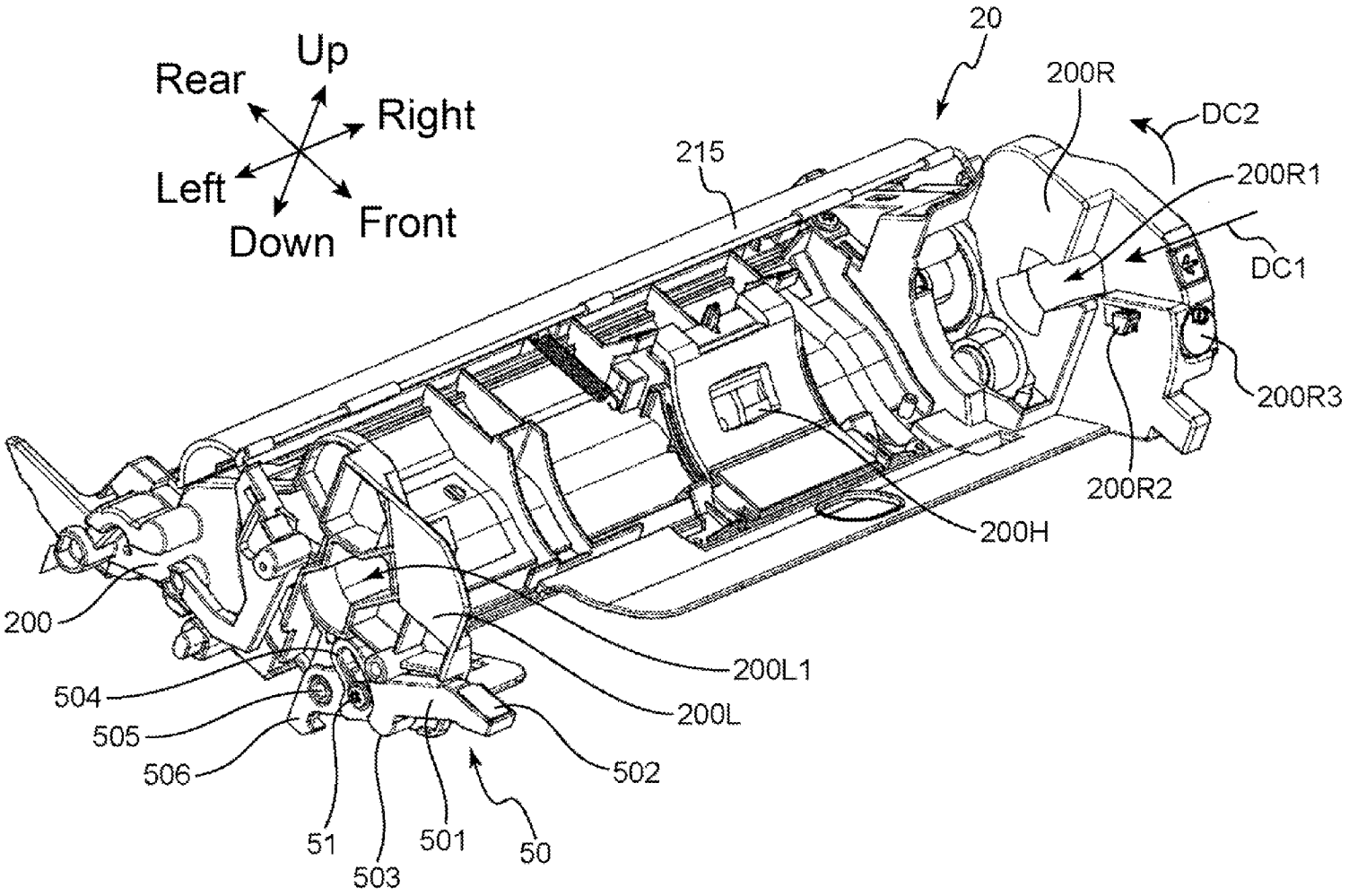
FIG. 5 obliquely illustrates a developing device according to the one embodiment.
Figure 6:
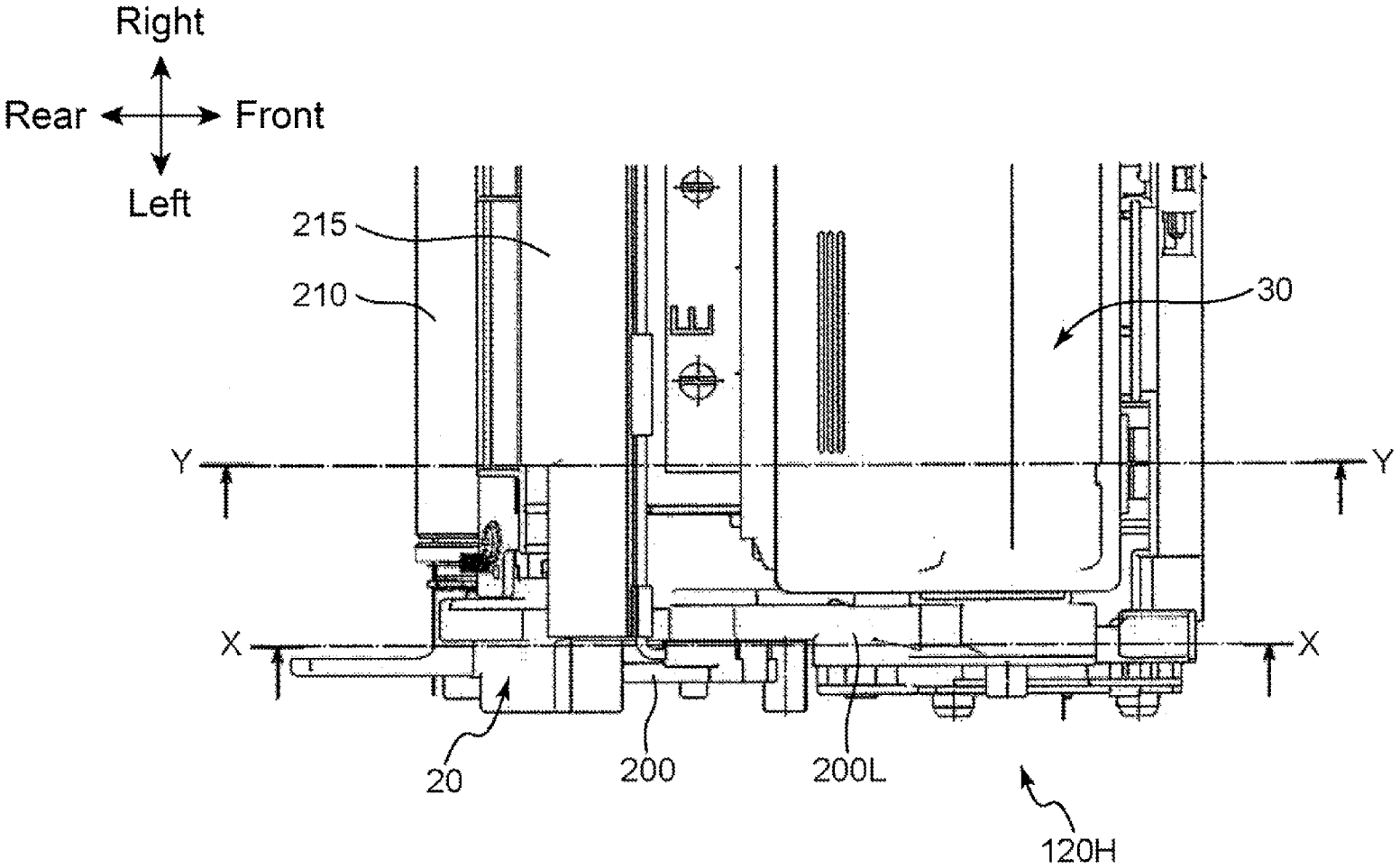
FIG. 6 illustrates a part of the top surface of the image forming unit according to the one embodiment.

Next, referring to FIGS. 3 to 10, the following describes in detail the image forming unit 120H (the developing device 20 and the toner container 30) according to the embodiment. FIG. 3 obliquely illustrates the image forming unit 120H and a main body unit 150 (a guiding portion), which will be described later, according to the embodiment. FIG. 4 obliquely illustrates the toner container 30 according to the embodiment. FIG. 5 obliquely illustrates the developing device 20 according to the embodiment. FIG. 6 illustrates a part of the top surface of the image forming unit 120H. FIGS. 7 to 10 illustrate cross sections of the image forming unit 120H and the main body unit 150. The respective cross-sectional views of FIGS. 7 and 8 correspond to the cross-sectional view at X-X line in FIG. 6, and the respective cross-sectional views of FIGS. 9 and 10 correspond to the cross-sectional view at Y-Y line in FIG. 6.

As described above, the image forming unit 120H (see FIG. 3) includes the developing device 20 and the toner container 30. The image forming unit 120H is attachable/detachable along a predetermined attachment/detachment direction with respect to the housing 101. This results in that the toner container 30 is attachable to the housing 101, integrally with the developing device 20. When the developing device 20 is first attached to the housing 101, the toner container 30 is independently attached to the developing device 20 inside the housing 101. An arrow DA in FIGS. 2 and 3 indicates an attachment direction of the image forming unit 120H with respect to the housing 101.

Figure 7:
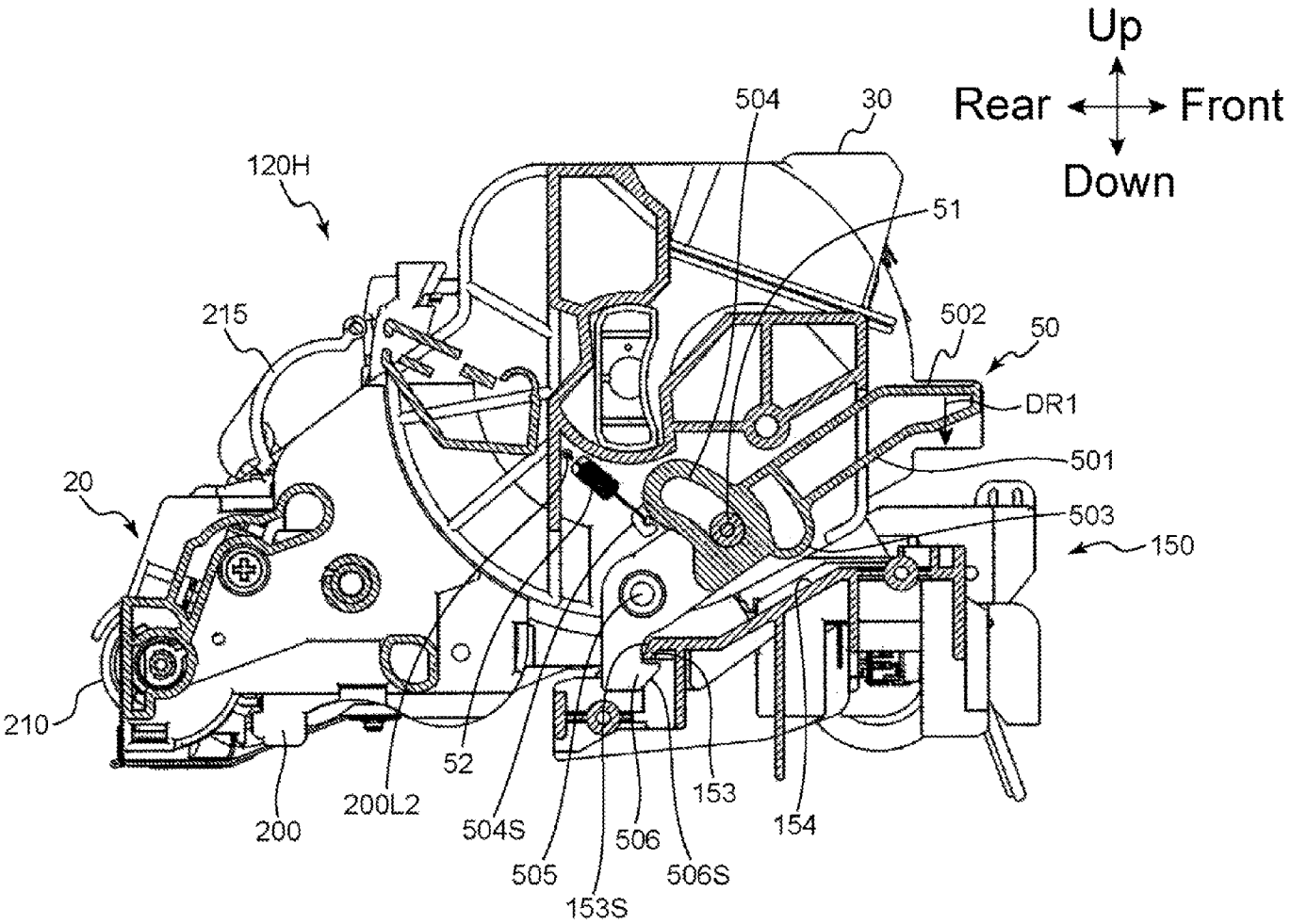
FIG. 7 illustrates a cross section of the image forming unit and the guiding portion according to the one embodiment.

Further, the printer 100 includes the main body unit 150 (the guiding portion) as illustrated in FIG. 3 and FIG. 7. The main body unit 150 is located in the housing 101 and guides attachment/detachment of the image forming unit 120H. As illustrated in FIG. 1, opening the front cover 106 with respect to the housing 101 exposes the main body unit 150 outside the housing 101. The image forming unit 120H is attached in the main-body internal space 107 of the housing 101 such that the image forming unit 120H passes through over the main body unit 150. As it appears in FIG. 3, the main body unit 150 has an approximately triangular shape from the side view and is a unit extending long in the lateral direction. The main body unit 150 includes positioning mechanisms 150S (see FIG. 9), an engaged portion 153 (see FIGS. 3 and 7), and a guide surface 154.

A pair of the positioning mechanisms 150S are located at both the end portions in the lateral direction of the main body unit 150. The positioning mechanism 150S includes an urging protrusion 151 (a unit-abutting portion) and a unit urging spring 152 (a first urging member). The urging protrusion 151 is brought in abutment on a housing pressed portion 200K (see FIG. 9) of the image forming unit 120H attached to the housing 101. The unit urging spring 152 urges the urging protrusion 151 toward the rear. In other words, the unit urging spring 152 urges the image forming unit 120H that is attached in a first position, which will be described later, inside the housing 101 toward the rear, and thus positions the image forming unit 120H.

The guide surface 154 (see FIG. 7) is formed on the top surface portion of the main body unit 150. The guide surface 154 has a function of guiding the attachment of the image forming unit 120H. The guide surface 154 has an inclined surface extending downward from the front toward the rear. In the guide surface 154, the further rear end side of this inclined surface is configured to be a horizontal surface. The engaged portion 153 is located in the distal end side of the attachment direction (the arrow DA direction in FIG. 3) of the image forming unit 120H with respect to the guide surface 154. A hook 506 (see FIG. 7) of a lock lever 50, which will be described later, is engageable with the engaged portion 153.

Referring to FIG. 4, the toner container 30 internally houses the toner (the developer). The toner container 30 includes a container main body 30A, a container lid portion 30B, and a container cover 30C. The container main body 30A has a shape extending in the lateral direction (the longitudinal direction). The top surface portion of the container main body 30A has an opening.

The container lid portion 30B is secured to the container main body 30A such that the container lid portion 30B covers the opening of the container main body 30A. In the embodiment, the container lid portion 30B is welded and fixed to the container main body 30A. The container lid portion 30B includes a first grip portion 32, a second grip portion 33, and a third grip portion 36. When attaching the toner container 30 to the developing device 20, or attaching the image forming unit 120H, which includes the toner container 30 and the developing device 20, to the housing 101, an operator is allowed to grip the first grip portion 32 and the second grip portion 33, or the first grip portion 32 and the third grip portion 36.

The container cover 30C is attached in the right side portion of the container main body 30A. The container cover 30C includes a container guide 31. The container guide 31 is a guide that is located to protrude from the container cover 30C and has an approximately rectangular parallelepiped shape. While it does not appear in FIG. 4, a guide with a shape identical to the container guide 31 is included in the side portion on the left side of the toner container 30. These guides guide the attachment of the toner container 30 to the developing device 20.

Figure 9:
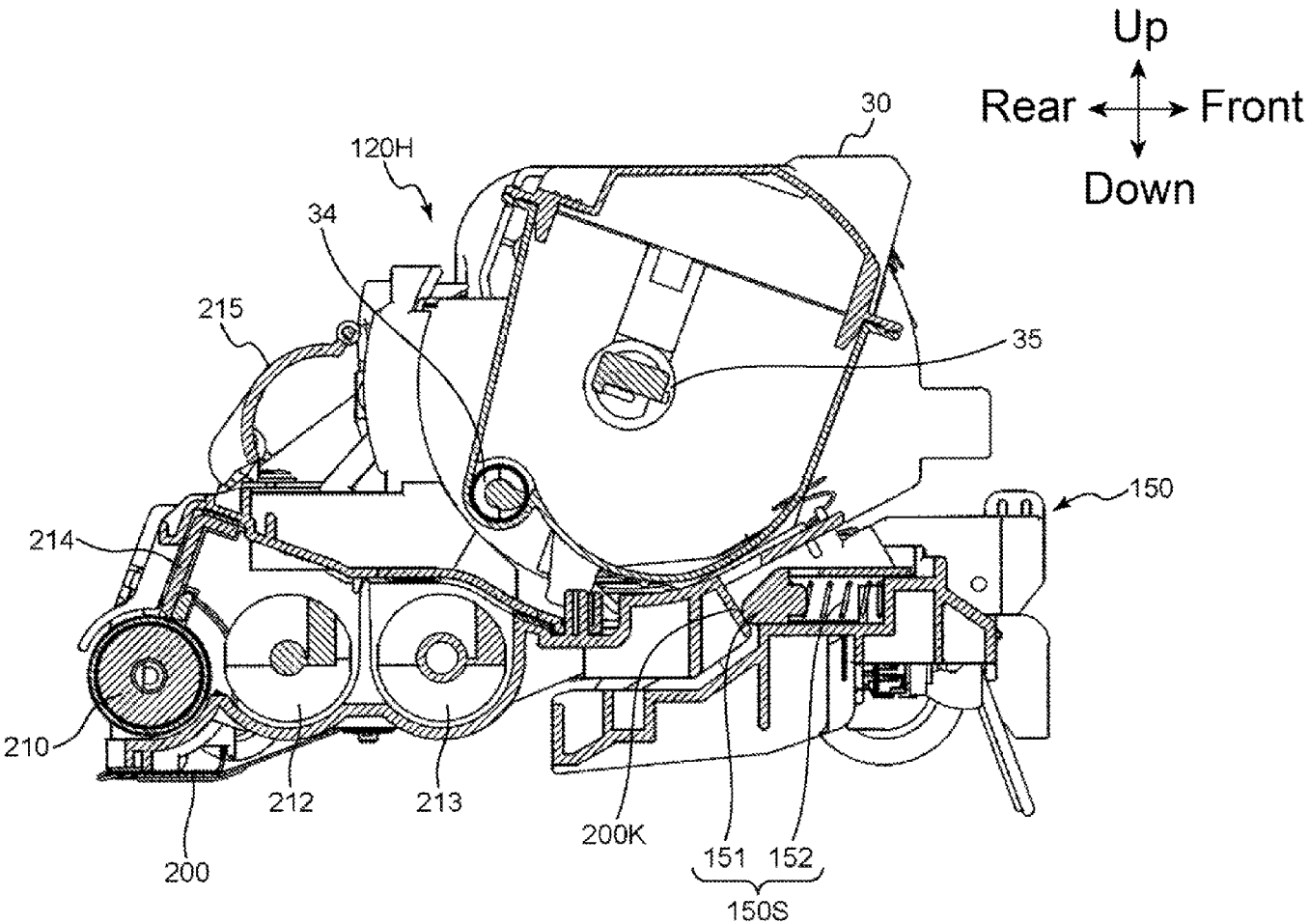
FIG. 9 illustrates the cross section of the image forming unit and the guiding portion according to the one embodiment.

Further, the toner container 30 includes a transport screw 34 and a stirring paddle 35 (see FIG. 9).

The transport screw 34 is a screw located along the bottom portion of the container main body 30A. The bottom portion of the container main body 30A has a toner discharge port (not illustrated) with an opening. The transport screw 34 is rotationally driven and conveys the toner inside the container main body 30A to the toner discharge port. Slidingly moving a shutter (not illustrated) included in the container main body 30A opens the toner discharge port and ensures discharge of the toner from the toner container 30. The stirring paddle 35 is rotatably supported inside the toner container 30 and stirs the toner housed inside the toner container 30.

The developing device 20 includes a development housing 200 (see FIG. 3), a developing roller 210 (see FIGS. 3 and 9), an abutting roller 211 (a spacing retainer, see FIG. 3), a first screw 212 (see FIG. 9), a second screw 213 (see FIG. 9), a layer thickness regulating member 214 (see FIG. 9), and a developing-roller cover 215.

The development housing 200 is a housing that supports the respective members of the developing device 20. The development housing 200 has a function of supporting the toner container 30. Referring to FIG. 5, the development housing 200 includes a housing-left-side wall 200L, a housing-right-side wall 200R, and a toner replenishment port 200H. The housing-left-side wall 200L and the housing-right-side wall 200R are wall portions located upright from both the end portions in the lateral direction of the development housing 200. The toner container 30 is attached between the housing-left-side wall 200L and the housing-right-side wall 200R.

The housing-right-side wall 200R includes a right-side guiding portion 200R1, a lock piece 200R2, and a pressing button 200R3. The housing-left-side wall 200L includes a left-side guiding portion 200L1. The right-side guiding portion 200R1 and the left-side guiding portion 200L1 are guide grooves formed in the housing-right-side wall 200R and the housing-left-side wall 200L, respectively. These guiding portions are formed along the attachment direction (an arrow DC1 in FIG. 5) of the toner container 30 with respect to the development housing 200. The container guide 31 (see FIG. 4) of the toner container 30 enters the right-side guiding portion 200R1. A guide (not illustrated) included in the left side surface of the toner container 30 enters the left-side guiding portion 200L1. The toner container 30 is turned in an arrow DC2 direction in FIG. 5 after inserted over the development housing 200. This results in that the toner discharge port (not illustrated) of the toner container 30 is opposed to the toner replenishment port 200H, and this ensures the toner replenishment to the developing device 20 from the toner container 30. The lock piece 200R2 locks the toner container 30, which has been turned in the arrow DC2 direction. Pressing the pressing button 200R3 releases the lock of the toner container 30 and turns the toner container 30 in a direction opposite to the arrow DC2 direction in FIG. 5. This results in that the toner container 30 is detachable from the developing device 20 in a direction opposite to the arrow DC1 direction.

The developing roller 210 is rotatably supported by the development housing 200. The developing roller 210 carries the developer constituted of the toner and a carrier on its circumference surface. The developing roller 210 supplies the toner to the photoreceptor drum 121 to develop the electrostatic latent image on the photoreceptor drum 121. A pair of the abutting rollers 211 are located at both the end portions in an axial direction of the developing roller 210. The abutting roller 211 holds a constant interval between the developing roller 210 and the photoreceptor drum 121 by being brought in abutment on the circumference surface of the photoreceptor drum 121. The first screw 212 and the second screw 213 are screws rotatably supported inside the development housing 200. The developer inside the development housing 200 is circulatory conveyed by the first screw 212 and the second screw 213. The developer is supplied to the developing roller 210 by the first screw 212. The layer thickness regulating member 214 regulates a layer thickness of the developer supplied on the developing roller 210. The developing-roller cover 215 is configured to be swingable with respect to the development housing 200. FIG. 3 illustrates a state where the developing-roller cover 215 has retreated over the developing roller 210. Swinging the developing-roller cover 215 downward from the state illustrated in FIG. 3 ensures that the developing-roller cover 215 covers the developing roller 210. Consequently, this prevents a foreign object from adhering on the developing roller 210 and prevents the peripheral area from being stained by the toner on the developing roller 210 when the image forming unit 120H is detached from the housing 101.

Further, the developing device 20 includes the lock lever 50 (a posture-switchable lever member, see FIGS. 3 and 5). The lock lever 50 is swingably located in the housing-left-side wall 200L of the developing device 20. The lock lever 50 has a first posture and a second posture, which are changeable. In the first posture, the lock lever 50 locks the image forming unit 120H (the developing device 20) at a first position, which will be described later, inside the housing 101. In the second posture, the lock lever 50 releases the lock of the image forming unit 120H and permits detachment of the image forming unit 120H from the housing 101 along the predetermined attachment/detachment direction.

Referring to FIGS. 3, 5, and 7, the lock lever 50 includes a lever main body 501, a lever pressed portion 502 (a pressed portion), an abutting portion 503, a guide groove 504, a fulcrum portion 505, and the hook 506.

The lever main body 501 is a main body portion of the lock lever 50 and, as illustrated in FIG. 7, is located so as to obliquely extend from the front and upper side toward the rear and lower side. The lever pressed portion 502 is a flat portion provided on the upper end portion of the lever main body 501. The lever pressed portion 502 is pressed by an operator before the image forming unit 120H is detached from the housing 101. The abutting portion 503 has a circular arc shape protruding downward, in the approximately center portion in a front-rear direction of the lock lever 50. As illustrated in FIGS. 3 and 7, attaching the image forming unit 120H inside the housing 101 causes the abutting portion 503 to be positioned opposed to the guide surface 154 of the main body unit 150. The guide groove 504 is a groove portion that opens in the rear of the abutting portion 503. The guide groove 504 opens so as to form a circular arc shape centered upon the fulcrum portion 505. The rear side of the guide groove 504 includes a lever-side lock portion 504S. The lever-side lock portion 504S has a hook shape located to protrude from the lock lever 50. One end of a lever-urging spring 52, which will be described later, is engagingly locked to the lever-side lock portion 504S.

The fulcrum portion 505 is located in the rear end side of the lock lever 50. The fulcrum portion 505 is rotatably supported by the housing-left-side wall 200L of the development housing 200. The fulcrum portion 505 is a fulcrum in swing of the lock lever 50. The above-described abutting portion 503 is located between the fulcrum portion 505 and the lever pressed portion 502 (see FIG. 7). The hook 506 is located in the opposite side to the lever pressed portion 502 with respect to the fulcrum portion 505. The hook 506 is engageable with the engaged portion 153 (see FIG. 7) of the main body unit 150. As illustrated in FIG. 7, the hook 506 extends downward from the fulcrum portion 505, and its distal end portion is bent forward (to the rear end side in the attachment direction of the image forming unit 120H).

Further, the developing device 20 includes a guide screw 51 and the lever-urging spring 52 (a second urging member, see FIG. 7). The guide screw 51 is inserted into the guide groove 504 and is a screw fastened to the housing-left-side wall 200L. The guide screw 51 has a function of guiding the swing of the lock lever 50 along the guide groove 504.

The lever-urging spring 52 is a spring member that expands and contracts between the housing-left-side wall 200L of the development housing 200 and the lock lever 50. The above-described housing-left-side wall 200L includes a housing-side lock portion 200L2. As illustrated in FIG. 7, one end of the lever-urging spring 52 is engagingly locked to the lever-side lock portion 504S of the lock lever 50, and the other end of the lever-urging spring 52 is engagingly locked to the housing-side lock portion 200L2. This results in that the lever-urging spring 52 urges the lock lever 50 around the fulcrum portion 505 such that the hook 506 engagingly locks to the engaged portion 153 (the lock lever 50 is in a first posture, which will be described later, see FIG. 7).

Next, the attachment/detachment of the image forming unit 120H with respect to the housing 101 will be described. As described above, the image forming unit 120H is constituted of the developing device 20 and the toner container 30. The toner container 30 is attachable/detachable with respect to the developing device 20. The image forming unit 120H is attachable to the housing 101 even with only the developing device 20 without including the toner container 30. Here, a description will be given of a state where the image forming unit 120H including the toner container 30 is attached and detached with respect to the housing 101.

As illustrated in FIG. 1, opening the front cover 106 of the housing 101 and the front end portion 102B of the upper wall 102 ensures attachment of the image forming unit 120H in the main-body internal space 107 of the housing 101. At this time, the image forming unit 120H is inserted into the main-body internal space 107 along the arrow DA direction in FIGS. 2 and 3. The main body unit 150 (see FIG. 3) guides the lower portion of the image forming unit 120H. In insertion of the image forming unit 120H, the hook 506 of the lock lever 50 moves rearward sliding on the guide surface 154. Afterward, an inclined surface 506S (see FIG.

7) of the hook 506 slidingly rubs against an inclined surface 153S of the engaged portion 153. At this time, in FIG. 7, slight clockwise turning of the hook 506 around the fulcrum portion 505 causes the distal end portion of the hook 506 to enter the lower side of the engaged portion 153. This results in that the hook 506 engages with the engaged portion 153, and the image forming unit 120H is locked in the first position illustrated in FIG. 7. The posture of the lock lever 50 in FIG. 7 is defined as the first posture. At this time, as illustrated in FIG. 9, the housing pressed portion 200K of the development housing 200 is pressed rearward by the urging protrusion 151 of the positioning mechanism 150S. That is, the positioning mechanism 150S urges the image forming unit 120H toward a direction where the developing roller 210 approaches the photoreceptor drum 121. Then, positioning the image forming unit 120H in the first position in FIGS. 7 and 9 in the housing 101 causes the abutting roller 211 (see FIG. 3) to be brought into abutment on the circumference surface of the photoreceptor drum 121 and thus arranges the developing roller 210 at a predetermined interval with respect to the photoreceptor drum 121. This results in stable supply of toner from the developing roller 210 to the photoreceptor drum 121 and formation of toner images on the photoreceptor drum 121.

Figure 8:
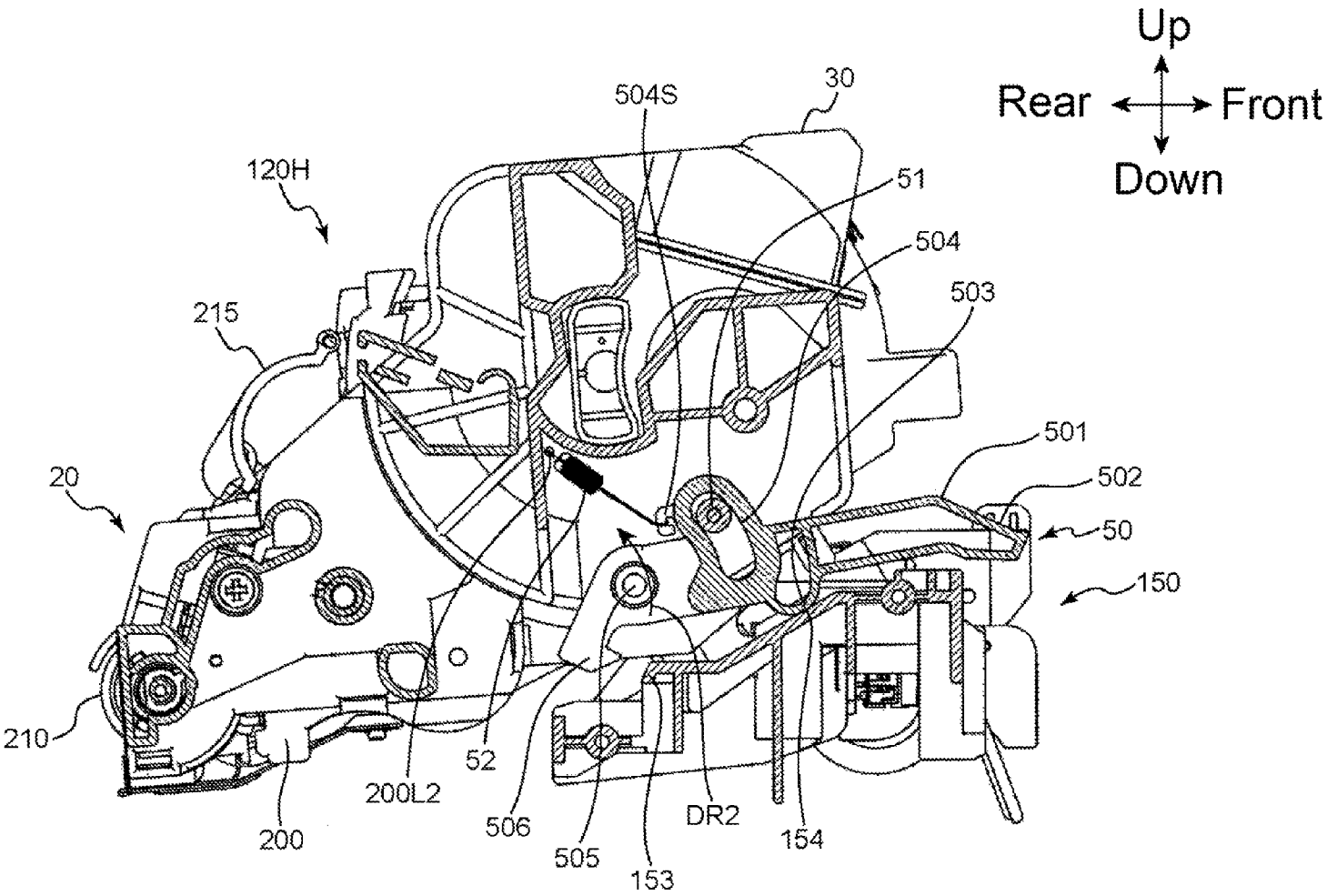
FIG. 8 illustrates a cross section of the image forming unit and the guiding portion according to the one embodiment.
Figure 10:
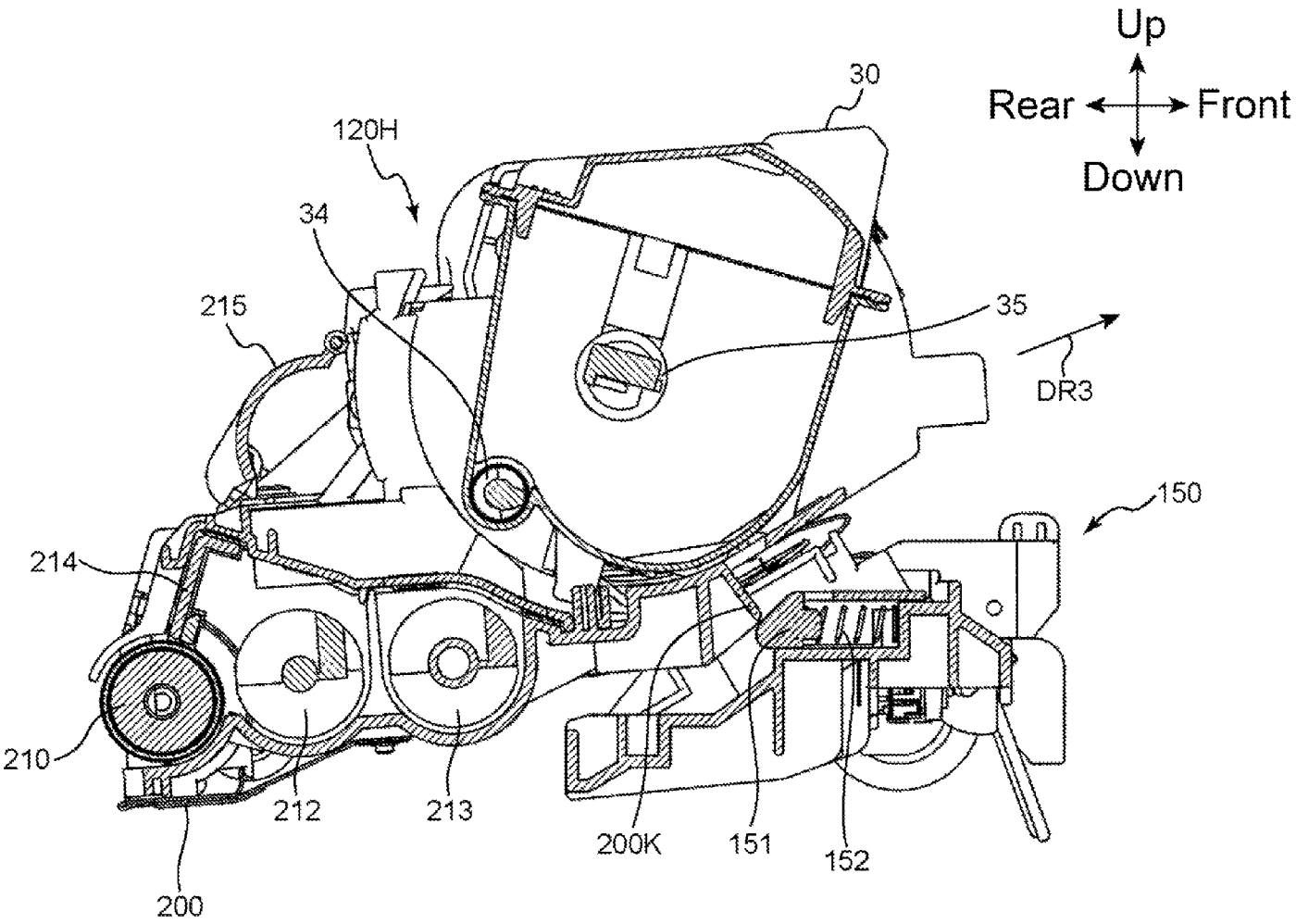
FIG. 10 illustrates the cross section of the image forming unit and the guiding portion according to the one embodiment.

When the image forming unit 120H is detached from the housing 101, as illustrated in FIG. 1, opening the front cover 106 of the housing 101 and the front end portion 102B of the upper wall 102 exposes the lever pressed portion 502 of the lock lever 50 outside the printer 100. The operator first presses the lever pressed portion 502 downward (an arrow DR1 in FIG. 7). This results in that the lock lever 50 swings around the fulcrum portion 505 against the urging force of the lever-urging spring 52 and takes the second posture illustrated in FIG. 8. At this time, the engagement of the hook 506 with the engaged portion 153 is released. Further pressing the lever pressed portion 502 causes the abutting portion 503 of the lock lever 50 to be brought in abutment on the guide surface 154, as illustrated in FIG. 8. Then, the image forming unit 120H is pushed up to a second position upward of the first position illustrated in FIG. 7, with this abutting portion 503 as the fulcrum and the fulcrum portion 505 being a load point (the arrow not a lead line in FIG. 1, and the arrow DR2 in FIG. 8). As illustrated in FIG. 10, this results in that the housing pressed portion 200K goes on the inclined surface of the urging protrusion 151, and the positioning of the image forming unit 120H by the positioning mechanism 150S is released. At this time, the urging force from the positioning mechanism 150S (the unit urging spring 152) is not strongly applied to the development housing 200. Consequently, this ensures easy detachment of the image forming unit 120H from the housing 101 along the above-described attachment/detachment direction (the arrow DR3 in FIG. 10).

After the image forming unit 120H has been pushed up in the arrow DR2 direction from the state illustrated in FIG. 8, bringing the hook 506 in abutment on the guide surface 154 (the above-described horizontal surface) on the upper side of the engaged portion 153 by the own weight of the image forming unit 120H holds the image forming unit 120H in the second position. Consequently, even when the operator releases his/her hand from the lock lever 50, this prevents the hook 506 from engaging again with the engaged portion 153. This ensures that the operator easily and surely detaches the image forming unit 120H.

In other embodiments, after the image forming unit 120H has been pushed up in the second position, if the inclined surface 506S (see FIG. 7) of the hook 506 is in abutting abutment on the inclined surface 153S of the engaged portion 153, the lock lever 50 is turnable around the fulcrum portion 505 in accordance with a pulling-out operation (the arrow DR3 in FIG. 10) of the image forming unit 120H. This similarly prevents the hook 506 from engaging again with the engaged portion 153.

As described above, according to this embodiment, swinging the lock lever 50 ensures the posture change between the first posture and the second posture. This results in the locking of the image forming unit 120H in the first position. The image forming unit 120H is permitted to be detached from the housing 101 along the predetermined attachment/detachment direction. Consequently, this easily and surely ensures performing the positioning and the attachment/detachment of the image forming unit 120H.

Pressing the lever pressed portion 502 of the lock lever 50 releases the lock of the image forming unit 120H and ensures the detachment of the image forming unit 120H. This results in that operation of the lock lever 50 by the operator ensures easy detachment of the image forming unit 120H.

Further, according to this embodiment, pressing the lever pressed portion 502 of the lock lever 50 releases the lock of the image forming unit 120H and pushes up the image forming unit 120H from the first position to the second position. At this time, the fulcrum portion 505 of the lock lever 50 serves as the load point when the image forming unit 120H is pushed up, as well as the fulcrum in swing of the lock lever 50. Consequently, only the continuous pressing of the lever pressed portion 502 of the lock lever 50 by the operator prepares a detachment operation of the image forming unit 120H.

The printer 100 that includes the image forming unit 120H according to the embodiment of the disclosure has been described above. According to this configuration, provided is the printer 100 that easily and surely ensures performing the positioning and the attachment/detachment of the image forming unit 120H. Further, this configuration easily and surely ensures performing the positioning and the attachment/detachment of the developing device 20 even when the toner container 30 is attached to the developing device 20. The disclosure is not limited to the embodiment described above, and, for example, the following modified embodiments are employable.

(1) While the embodiment described above has described the aspect where the image forming unit 120H includes the developing device 20 and the toner container 30, the disclosure is not limited to this. The image forming unit 120H may include only the developing device 20, and the image forming unit 120H may include the photoreceptor drum 121.

(2) While the embodiment described above has described the aspect where the abutting roller 211 is included as the spacing retainer, the disclosure is not limited to this. A component of form other than that of a roller may be employed as the spacing retainer.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

an image forming unit attachable to and detachable from the apparatus main body along a predetermined attachment/detachment direction with respect to the apparatus main body;

a guiding portion disposed in the apparatus main body, for guiding attachment/detachment of the image forming unit;

a positioning mechanism disposed on the guiding portion, and provided with a first urging member and a unit-abutting portion for abutting on the image forming unit, the positioning mechanism positioning the image forming unit by urging the image forming unit when attached into the apparatus main body in a first position; and a posture-switchable lever member provided to be movable through a swing on the image forming unit, the posture-switchable lever member switching between a first posture in which the posture-switchable lever member locks the image forming unit in the first position within the apparatus main body, and a second posture in which the posture-switchable lever member releases the lock on the image forming unit and permits the image forming unit to be detached from the apparatus main body along the attachment/detachment direction.

2. The image forming apparatus according to claim 1, wherein:

the guiding portion is provided with a guide surface that guides attachment/detachment of the image forming unit, and an engaged portion located in a distal end side in an attachment direction of the image forming unit with respect to the guide surface;

the posture-switchable lever member includes a fulcrum portion as a fulcrum of the swing, a pressed portion that is pressed prior to the image forming unit being detached from the apparatus main body, and a hook disposed on an opposite side of the posture-switchable lever member from the pressed portion with respect to the fulcrum portion, the hook being engageable with the engaged portion of the guiding portion;

the image forming unit further includes a second urging member for urging the posture-switchable lever member about the fulcrum portion so as to put the posture-switchable lever member in the first posture; and when the pressed portion of the posture-switchable lever member is pressed in a state where the hook on the posture-switchable lever member in the first posture engages with the engaged portion and the image forming unit is locked in the first position, the posture-switchable lever member swings about the fulcrum portion against the urging force of the second urging member to assume the second posture, and the engagement of the hook with the engaged portion is released, whereby the image forming unit becomes detachable from the apparatus main body along the attachment/detachment direction.

3. The image forming apparatus according to claim 2, wherein:

the posture-switchable lever member includes an abutting portion disposed opposed to the guide surface of the guiding portion between the fulcrum portion and the pressed portion; and when the pressed portion of the posture-switchable lever member is pressed in a state where the image forming unit is locked in the first position, and is further pressed after the engagement of the hook with the engaged portion is released, the abutting portion is brought into abutment on the guide surface, and, with the fulcrum portion being made a load point with the abutting portion as a fulcrum, the image forming unit is pushed up to a second position in a direction upward beyond the first position, whereby the positioning of the image forming unit by the positioning mechanism is released.

4. The image forming apparatus according to claim 3, wherein bringing the hook in abutment on the guide surface on the upper side of the engaged portion by the own weight of the image forming unit holds the image forming unit in the second position.

5. The image forming apparatus according to claim 1, further comprising:

an image carrier that is rotatably located to the apparatus main body and has a circumference surface on which an electrostatic latent image is formed; wherein the image forming unit includes a developing device including a developing roller that supplies developer to the image carrier, the positioning mechanism urges the image forming unit toward a direction where the developing roller approaches the image carrier, and positioning the image forming unit in the first position inside the apparatus main body arranges the developing roller at a predetermined interval with respect to the image carrier.

6. The image forming apparatus according to claim 5, wherein the developing device is disposed at either of axial end portions of the developing roller, and includes a spacing retainer abutting on the circumferential surface of the image carrier.

7. The image forming apparatus according to claim 5, wherein the image forming unit is rendered attachable/detachable with respect to the developing device, and further includes a developer container rendered integrally attachable/detachable with the developing device with respect to the apparatus main body.

* * * * *